US012320053B2

(12) United States Patent
Aguiar, Jr. et al.

(10) Patent No.: US 12,320,053 B2
(45) Date of Patent: Jun. 3, 2025

(54) APPLIANCE AND METHOD FOR DETERMINING AN OPERATIONAL STATE OF A COMPONENT

(71) Applicant: Haier US Appliance Solutions, Inc., Wilmington, DE (US)

(72) Inventors: Ricardo Alberto Aguiar, Jr., Clarksville, IN (US); Maegan Gail Williams, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 178 days.

(21) Appl. No.: 18/095,848

(22) Filed: Jan. 11, 2023

(65) Prior Publication Data

US 2024/0229321 A1 Jul. 11, 2024

(51) Int. Cl.

| | |
|---|---|
| ***D06F 34/20*** | (2020.01) |
| ***A47L 15/00*** | (2006.01) |
| ***D06F 33/47*** | (2020.01) |
| ***D06F 103/26*** | (2020.01) |

(52) U.S. Cl.

CPC ..... *D06F 34/20* (2020.02); *A47L 15/0049* (2013.01); *D06F 33/47* (2020.02); *A47L 2401/06* (2013.01); *A47L 2401/32* (2013.01); *D06F 2103/26* (2020.02)

(58) Field of Classification Search

CPC ..... A47L 15/0049; A47L 15/4221; A47L 2401/32

See application file for complete search history.

(56) References Cited

U.S. PATENT DOCUMENTS

| | | | | |
|---|---|---|---|---|
| 6,625,568 | B2 | 9/2003 | Tyson | |
| 8,357,246 | B2 | 1/2013 | Sundaram | |
| 2002/0165695 | A1* | 11/2002 | Tyson | A47L 15/0049 702/182 |
| 2007/0181156 | A1* | 8/2007 | Uz | A47L 15/0049 134/109 |
| 2014/0015814 | A1 | 1/2014 | Santana et al. | |
| 2021/0219811 | A1* | 7/2021 | Horn | A47L 15/22 |

FOREIGN PATENT DOCUMENTS

| | | | |
|---|---|---|---|
| DE | 3803006 | A1 * | 3/1989 |
| DE | 4010066 | C2 | 11/1997 |
| DE | 102014205266 | A1 | 9/2015 |

OTHER PUBLICATIONS

Machine Translation DE3803006A1 (Year: 1989).*

* cited by examiner

*Primary Examiner* — Spencer E. Bell
(74) *Attorney, Agent, or Firm* — Dority & Manning, P.A.

(57) ABSTRACT

An appliance and method for determining an operational state of the appliance is provided. The appliance includes a cabinet, a flow device, and a sensor positioned at the cabinet. The cabinet includes a plurality of panels forming an interior volume at which a wash chamber is positioned. The flow device is configured to flow a fluid at the wash chamber. The sensor is positioned at the cabinet and configured to obtain sound vibrations from the wash chamber. The method includes obtaining, from the sensor, a signal during flow of a fluid at the wash chamber, and comparing the signal to a predetermined operational profile corresponding to operation of the flow device at the wash chamber to determine whether the flow device is operating properly.

16 Claims, 2 Drawing Sheets

APPLIANCE AND METHOD FOR DETERMINING AN OPERATIONAL STATE OF A COMPONENT

FIELD

The present subject matter relates generally to appliances, and more particularly, to washing appliances and methods for determining an operational state of a component at the appliance.

BACKGROUND

Appliances, such as dishwashing appliances or laundry washing appliances, may include diverters or other components that direct, divert, or switch a flow of fluid between chambers, nozzles, spray arms, or other flow devices. Diverters and flow devices may form flow assemblies that are configured to spray fluid into a wash chamber. A flow assembly may malfunction due to a fault at the flow device, at the diverter, or both. Malfunctions, faults, or failures at a diverter or flow device may cause other components to function improperly or inefficiently, such as pumps, motors, spray arms, or diverters.

A method for determining a fault at a flow assembly would be advantageous and beneficial. Furthermore, a system and method for determining an operational state or fault at a particular component of the appliance would be advantageous and beneficial.

BRIEF DESCRIPTION

Aspects and advantages of the invention will be set forth in part in the following description, or may be understood from the description, or may be learned through practice of the invention.

An aspect of the present disclosure is directed to an appliance including a cabinet, a flow device, and a microphone positioned at the cabinet. The cabinet includes a plurality of panels forming an interior volume at which a wash chamber is positioned. The flow device is configured to flow a fluid at the wash chamber. The microphone is positioned at the cabinet and configured to obtain sound vibrations from the wash chamber.

Another aspect of the present disclosure is directed to a method for determining an operational state of a component at an appliance. The method includes obtaining, from a sensor positioned at a cabinet at which a wash chamber is positioned, a signal during flow of a fluid at the wash chamber, and comparing the signal to a predetermined operational profile corresponding to operation of the flow device at the wash chamber to determine whether the flow device is operating properly.

Still another aspect of the present disclosure is directed to a washing appliance. The washing appliance includes a cabinet, a flow device, a flow control device, a microphone positioned at the cabinet, a pump, and a controller. The cabinet includes a plurality of panels forming an interior volume at which a wash chamber is positioned. The flow device is configured to flow a fluid at the wash chamber. The flow control device is configured to switch a direction of the flow of fluid. The microphone is configured to obtain sound vibrations from the wash chamber. The pump is configured to move the fluid to or from the wash chamber. The controller configured to execute operations, the operations including obtaining a signal from the microphone during flow of the fluid at the wash chamber, and comparing the signal to a predetermined audio profile corresponding to operation of the flow device at the wash chamber to determine whether the flow device is operating properly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
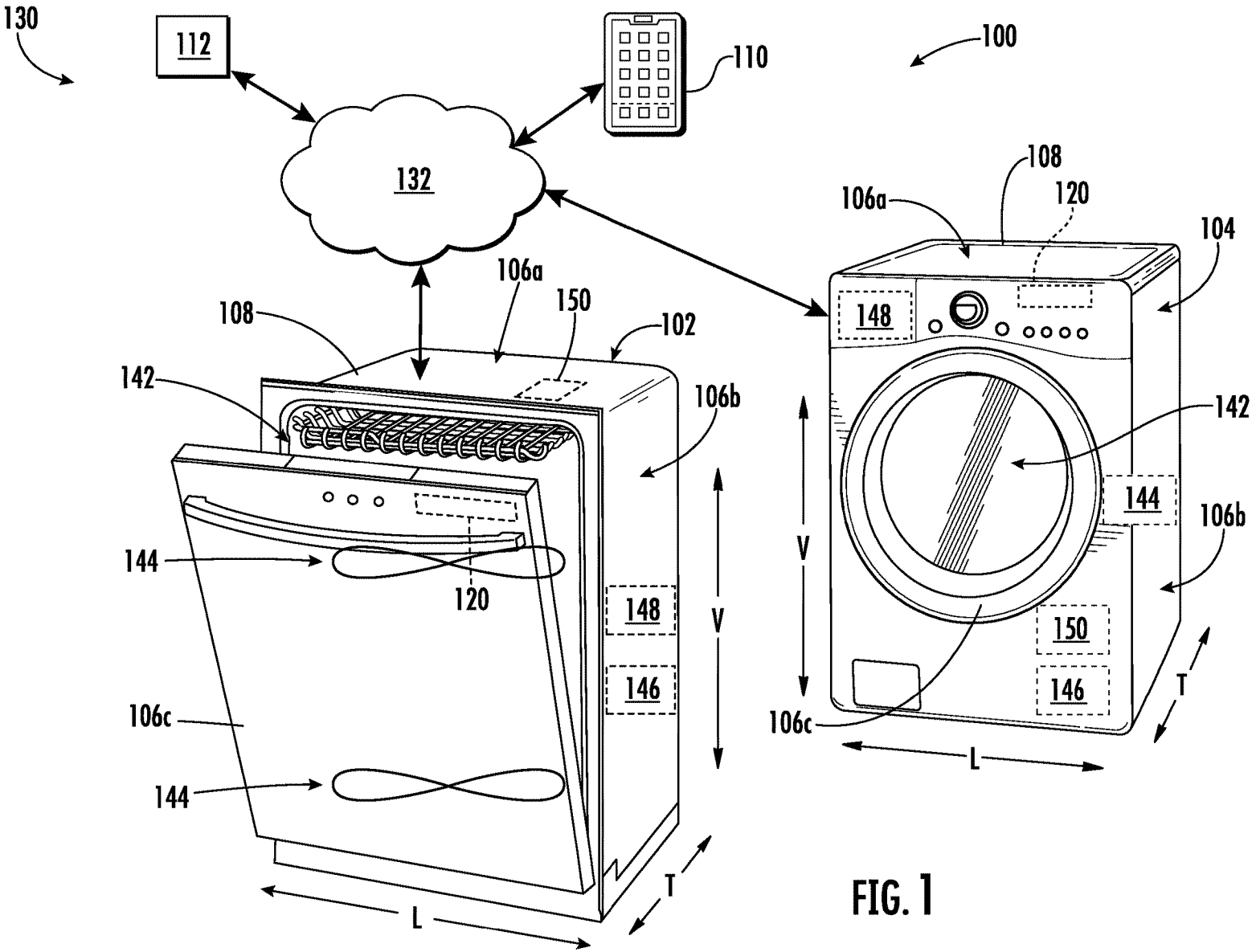
FIG. 1 depicts a schematic embodiment of a computing network for operating an appliance in accordance with aspects of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Appliances and methods for determining operational state at an appliance and fault detection are provided herein. Embodiments of the appliances include dishwashing appliances, laundry washing appliances, or appliances generally including fluid flow devices configured to spray, propel, move, or agitate a fluid (e.g., wash fluid, water, etc.) by or through a flow device (e.g., spray arm, agitator, impeller, nozzle, etc.) in a wash chamber. Embodiments of the appliance include a sensor configured to receive sound vibrations generated by the fluid contacting a surface of the wash chamber in a medium, and translate the sound vibrations into electrical or electronic signals. A controller is configured to receive the signal and determine whether the signal corresponds to a properly functioning flow pattern, or to a particular flow device versus another flow device, or deviations from one or more flow patterns or flow devices, such as further described herein.

Referring now to FIG. 1, a computing network 100 including one or more appliances 102, 104 will be described according to exemplary embodiments of the present subject matter. In general, the network 100 may include any suitable number, type, and configuration of appliances such as described herein, remote servers, network devices, and/or other external devices. Some of these appliances 102, 104 may be able to communicate with each other or may otherwise be interconnected. This interconnection, interlinking, and interoperability of multiple appliances and/or devices may commonly be referred to as "smart home" or "connected home" appliance interconnectivity.

The appliance 102, 104 includes a plurality of panels 106 forming a cabinet 108 at which a wash chamber 142 is positioned. The plurality of panels 106 may include a top or upper panel 106*a*, side panels 106*b*, or a door 106*c*. The panels 106 include exterior faces (i.e., exterior of the appliance 102, 104) and interior faces (e.g., forming an interior volume at which the wash chamber 142 and other components is positioned).

The appliances 102, 104 are generally configured to circulate, re-circulate, drain or otherwise move fluid (e.g., water, wash fluid, detergent, water-detergent mixture, etc.) into or through the wash chamber 142. As schematically depicted in FIG. 1, appliance 102, 104 may include the wash chamber 142 at which articles (e.g., dishes, utensils, containers, etc. at appliance 102, or laundry articles, clothing, etc. at appliance 104) may receive fluid from a flow device 144, such as may be understood in the art. As further understood in the art, appliance 102, 104 includes any appropriate flow device 144 configured to provide, dispense, agitate, eject, spray, flow, distribute, or otherwise move fluid into or through the wash chamber 142. Various embodiments of the flow device 144 may include flow nozzles, rotatable vanes or blades, spray arms, agitators, or other appropriate flow structures.

In some embodiments, the appliance includes a plurality of flow devices 144. For instance, appliance 102 schematically depicts the flow devices 144 as an upper and lower rotatable spray arms in a dishwashing appliance. The flow devices 144 are configured to rotate as fluid is received and ejected therethrough into the wash chamber 142. In still some embodiments, the appliance includes flow device(s) 144 configured as stationary devices configured to receive and eject fluid into the wash chamber 142.

In various embodiments, appliance 102, 104 may include a flow control device 148 configured to selective permit, inhibit, throttle, direct, or divert flow of fluid. For instance, the flow control device 148 may be configured to direct fluid to one or another, or all of, the flow devices 144, such as one or another of the upper or lower spray arms schematically depicted at appliance 102. In various embodiments, the flow control device 148 is configured as a diverter, multi-way valve, etc. In still various embodiments, the flow control device 148 may be configured as a passive diverter device or an active diverter device, such as may be operably coupled to controller 120 to selectively open, close, or change positions based on a control signal.

Various embodiments of appliance 102, 104 may include a pump 146 or other device allowing or promoting flow, or pressurized flow, of fluid into, through, or out of the wash chamber 142. For instance, the pump 146 may be configured to provide pressurized fluid to and through the flow device 144 and eject or propel the fluid into the wash chamber 142. It should be appreciated that "fluid", as provided herein, includes water, water-detergent mixture, detergent, cleaning solution, or combinations thereof, or aerated combinations thereof including a gaseous fluid (e.g., air) mixed therewith. In still various embodiments, the pump 146 is configured to transmit a current draw signal corresponding to electrical current draw at the pump 146. The pump 146 may be communicatively coupled to the controller 120, such as to send and/or receive measurement or control signals between the pump 146 and the controller 120. The current draw signal may correspond to a current measurement or calculation, or interpolation or calculation based on one or more other parameters (e.g., voltage, resistance, etc.), corresponding to operation of the pump 146 to move fluid to or through the flow device 144, or from the wash chamber 142, or combinations thereof.

Appliance 102, 104 includes one or more sensors 150 configured to measure, determine, or otherwise obtain vibrations generated by the fluid contacting a surface of the wash chamber 142, and translate the vibrations into electrical or electronic signals. In certain embodiments, the sensor 150 is configured to measure, determine, or otherwise obtain sound vibrations generated by the fluid contacting a surface of the wash chamber 142, and translate the sound vibrations into electrical or electronic signals. In such embodiments, sensor 150 may be configured as any appropriate microphone device, such as any appropriate transducer configured to convert sound or pressure vibrations into an electrical signal. Sensor 150 may be a single, integral component, or may include a plurality of sensors 150 each configured to generate, obtain, transmit, etc. signals corresponding to sound or pressure vibrations operating at appliance 102, 104. Sensor 150 is communicatively and operably coupled to various components of appliance 102, 104, such as controller 120, such as to communicate signals from sensor 150 to controller 120. In various embodiments, the sensor 150 is configured as a piezoelectric microphone, a crystal microphone, or piezo microphone, such a configured to produce a voltage when subjected to vibrations, such as sound vibrations or generally fluid pressure vibrations.

In various embodiments, the sensor 150 is positioned at the cabinet 108. In some embodiments, the sensor 150 is positioned at an interior volume formed by the plurality of panels 106. In still some embodiments, the sensor 150 is positioned at the cabinet 108 at an interior surface or face of one or more panels 106 forming the cabinet 108. During operation of the appliance 102, 104, fluid is ejected from the flow device 144 into the wash chamber 142. The fluid ejected from the flow device 144 may contact one or more surfaces of the wash chamber 142. For instance, fluid may contact a surface at the wash chamber 142 substantially opposite from the flow device 144 from which the fluid is ejected. In various instances, fluid may initially contact a surface at the wash chamber 142 substantially opposite from the flow device 144 after initial contact with articles within wash chamber 142. In some embodiments, the sensor 150 is positioned at the panel 106 opposite from the flow device 144, such as proximate to the surface at the wash chamber 142 at which fluid contacts when ejected from the flow device 144. In various instances, the sensor 150 is positioned at the panel 106 proximate to the surface at the wash chamber 142 opposite of the flow device 144 from which fluid is ejected. In some embodiments, such as depicted at appliance 102, the upper panel 106*a* is opposite of the flow device 144 such as described herein, and the sensor 150 is positioned at the upper panel 106*a*. However, it should be appreciated that in various embodiments one or more side panels 106*b* or door 106*c* may be positioned opposite of the flow device 144, and the sensor 150 may be positioned at the side panel 106*b* or door 106*c*.

As depicted in FIG. 1, appliance 102 may form a dishwashing appliance and appliance 104 may form a laundry washing appliance. Details regarding the components and operation of appliances 102, 104 may be understood by one having ordinary skill in the art and further detailed discussion is omitted herein for brevity. However, it should be appreciated that the specific appliance types and configurations are only exemplary and are provided to facilitate discussion regarding the use and operation of an exemplary computing network 100 for one or more appliances such as described herein. The scope of the present subject matter is not limited to the specific number, type, and configurations of appliances set forth herein.

In certain embodiments, computing network 100 may include one or more external devices, e.g., devices that are separate from or external to the one or more appliances 102, 104, and which may be configured for facilitating communications with various appliances or other devices. For example, the computing network 100 may include or be communicatively coupled with a remote user interface device 110 that may be configured to allow user interaction with some or all appliances 102, 104 or other devices in the computing network 100.

In general, remote user interface device 110 may be any suitable device separate and apart from appliances 102, 104 that is configured to provide or receive communications, information, data, or commands from a user, such as further described herein. In this regard, remote user interface device 110 may be an additional user interface to the user interface panels of the various appliances within the computing network 100. In this regard, for example, the user interface device 110 may be a personal phone, a smartphone, a tablet, a laptop or personal computer, a wearable device, a smart home system, or another mobile or remote device. For example, the separate device may be a smartphone operable to store and run applications, also known as "apps," and the user interface device 110 be provided as a smartphone app.

In still some embodiments, user interface device 110 may be affixed to or form a part of another appliance (e.g., refrigeration appliance), such as may provide for centralized communication among a plurality of appliances including one or more of appliances 102, 104. Appliances to which user interface device 110 is operably coupled may be configured substantially similarly as a personal phone, a smartphone, a tablet, a laptop or personal computer, a wearable device, a smart home system, or another mobile or remote device.

As will be described in more detail below, some or all of the computing network 100 may include or be communicatively coupled with a database storage device or remote server 112 that may be in operative communication with some or all appliances within computing network 100. Thus, in certain embodiments, user interface device 110 and/or remote server 112 may refer to one or more devices that are not considered dishwashing or laundry appliances as used herein. In addition, devices such as a personal computer, router, network devices, and other similar devices whose primary functions are network communication and/or data processing are not considered dishwashing or laundry appliances as used herein.

As illustrated, each of appliance 102, 104, user interface device 110, or any other devices or appliances in computing network 100 may include or be operably coupled to a controller 120. Controller 120 is configured to store instructions, receive signals, and regulate operation at appliance 102, 104. The controller 120 may be positioned in a variety of locations throughout appliance 102, 104 (e.g., a control panel area, at a door, etc.). In some embodiments, input/output ("I/O") signals are routed between controller 120 and various operational components of appliance 102, 104 along wiring harnesses that may be routed, e.g., through the bottom of a door. Controller 120 may include a user interface panel through which a user may select various operational features and operating modes and monitor progress of the appliance 102, 104. The user interface may represent a general purpose I/O ("GPIO") device or functional block. Additionally, the user interface may include input components, such as one or more of a variety of electrical, mechanical, or electro-mechanical input devices including rotary dials, push buttons, and touch pads. The user interface may also include a display component, such as a digital or analog display device designed to provide operational feedback to a user. The user interface may be in communication with the controller 120 via one or more signal lines or shared communication buses.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 120 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 120, user interface device 110, and remote server 112 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors. Executed instructions cause the computing network 100, or the appliances 102, 104, remote server 112, or user interface device 110 in particular, to perform operations, such as one or more steps of method 1000 provided further herein.

For example, controller 120 may be operable to execute programming instructions or micro-control code associated with an operating cycle or operating mode of appliance 102, 104. In this regard, the instructions may be software or any set of instructions that when executed by the processing device, cause the processing device to perform operations, such as running one or more software applications, displaying a user interface, receiving user input signals, processing user input signals, receiving measurement signals, generating control signals or user messages, or adjusting appliance operation based on one or more received or generated signals.

Moreover, it should be noted that controller 120 as disclosed herein is additionally, or alternatively, configured to store, execute, or otherwise operate or perform any one or more methods, method steps, or portions of methods as disclosed herein. For example, in some embodiments, methods disclosed herein may be embodied in programming instructions stored in the memory at one or more of controller 120, user interface device 110, or remote server 112, and executed by controller 120, user interface device 110, or remote server 112. The memory devices may also store data that can be retrieved, manipulated, created, or stored by the one or more processors or portions of controller 120. One or more database(s) can be connected to controller 120 through any suitable communication module, communication lines, or network(s) (e.g., computing network 132). Such databases, as further described herein, are stored at one or more of controller 120, user interface device 110, remote server 112.

Referring still to FIG. 1, a schematic diagram of an external communication system 130 will be described according to an exemplary embodiment of the present subject matter. In general, external communication system 130 is configured for permitting interaction, data transfer, and other communications between and among one or more of the appliances 102, 104 user interface device 110, and the remote server 112. For example, this communication may be used to transmit packets of data or datasets through a network 132 and to the remote server 112 and to receive at one or more appliances 102, 104 one or more control signals, user signals, location signals, operational state signals, or other signals, messages, or adjustments corresponding to one or more of operating parameters, cycle settings, user instructions or notifications, performance characteristics, user preferences, or any other suitable information for improved performance of one or more appliances within system of appliances 100.

In addition, remote server 112 may be in communication with the appliance 102, 104 and/or user interface device 110 through the network 132. In this regard, for example, remote server 112 may be a cloud-based server 112, and is thus located at a distant location, such as in a separate state, country, etc. According to an exemplary embodiment, user interface device 110 may communicate with a remote server 112 over network 132, such as the Internet, to transmit/receive signals, data packets or information, datasets, provide user inputs, receive user notifications or instructions, access databases, interact with or control the appliance 102, 104, etc. In addition, user interface device 110 and server 112 may communicate with the appliance 102, 104 to communicate similar information.

In general, communication between the appliance 102, 104, user interface device 110, server 112, and/or other user devices or appliances may be carried using any type of wired or wireless connection and using any suitable type of communication network, non-limiting examples of which are provided below. For example, user interface device 110 may be in direct or indirect communication with the appliance 102, 104 through any suitable wired or wireless communication connections or interfaces, such as network 132. For example, network 132 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

Communication system 130 is described herein according to an exemplary embodiment of the present subject matter. However, it should be appreciated that the exemplary functions and configurations of communication system 130 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Figure 2:
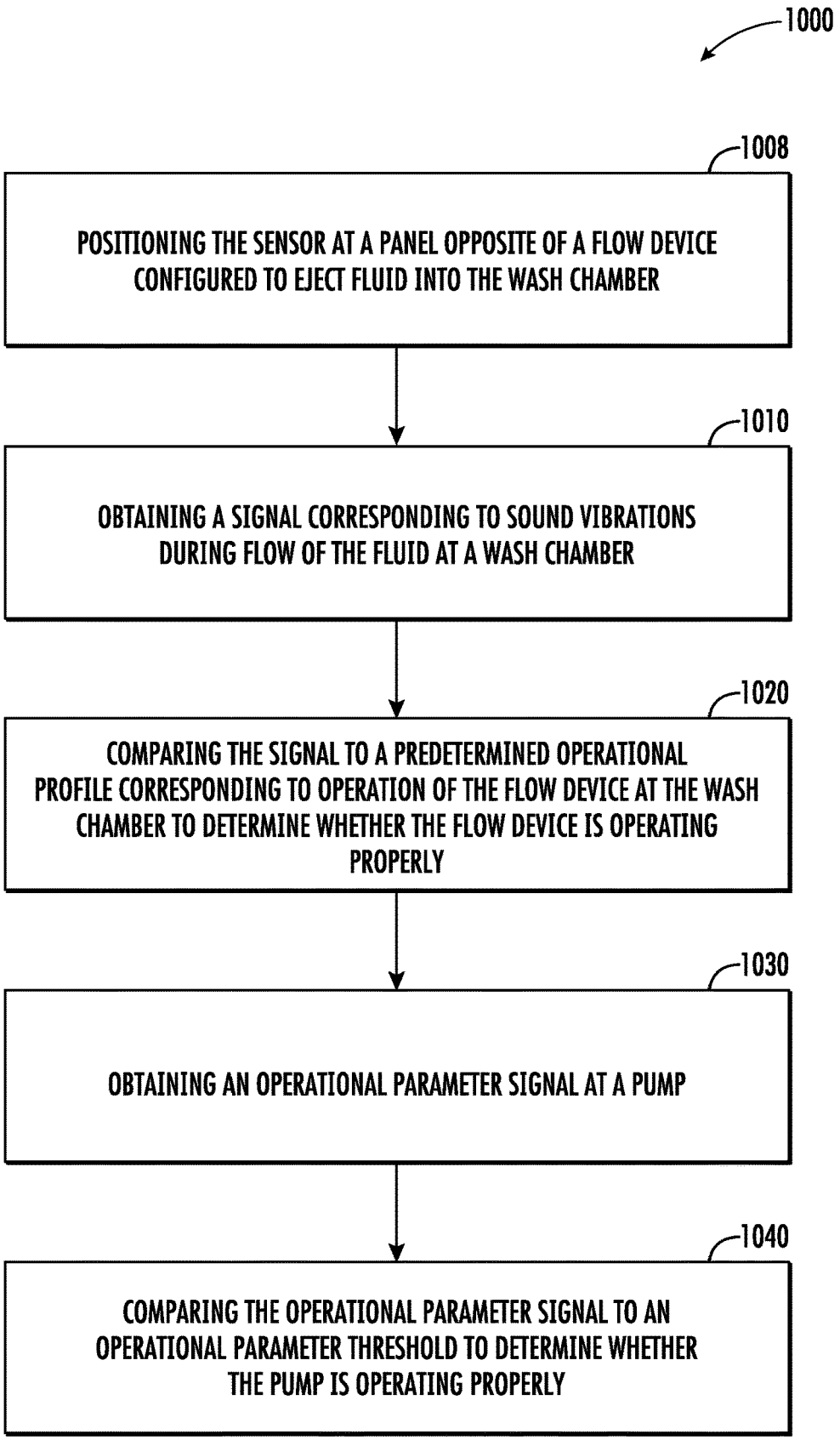
FIG. 2 is a flowchart outlining exemplary steps of a method for determining operational state at an appliance.

Referring now to FIG. 2, a flowchart outlining exemplary steps of a method for determining operational state at an appliance (e.g., appliance 102, 104) is provided (hereinafter, "method 1000"). In particular embodiments, method 1000 provides steps for fault detection, determining a fault, determining a faulty component, determining operational state of a component at the appliance, or method for operating a dishwashing appliance or laundry washing appliance. Embodiments of the method 1000, when stored or executed at one or more of controller 120, server 112, or user interface device 110, or generally stored, accessed, or executed across computing network 100, form a system for determining a fault, such as a component fault or failure, at the appliance 100.

Method 1000 includes at 1010 obtaining a signal from a sensor (e.g., sensor 150) configured to receive, obtain, or otherwise measure sound vibrations during flow of the fluid at a wash chamber (e.g., wash chamber 142). In some embodiments, step 1010 includes obtaining a signal from a microphone during flow of the fluid at a wash chamber.

In some embodiments, method 1000 includes at 1008 positioning the sensor at a panel (e.g., panel 106 forming cabinet 108) opposite of a flow device (e.g., flow device 144) configured to eject fluid into the wash chamber. The sensor, such as configurations of the microphone described herein, may be positioned at one or more panels, such as the upper panel 106*a*, the side panels 106*b*, door 106*c*, or combinations thereof. In some embodiments, the sensor may be positioned generally at one or more panels opposite of a flow device (e.g., flow device 144) from which fluid is ejected into the wash chamber.

Method 1000 includes at 1020 comparing the signal to a predetermined operational profile corresponding to operation of the flow device at the wash chamber to determine whether the flow device is operating properly. In some embodiments, method 1000 includes at 1020 comparing the signal to a predetermined audio profile corresponding to operation of the flow device at the wash chamber to determine whether the flow device is operating properly. For instance, the audio profile may be a graph, table, chart, or other data corresponding to a frequency and amplitude over a period of time for a flow device operating in the desired state, such as may be obtained from testing or calculation of a representative corresponding appliance or obtained from signals from a plurality of appliances received via the computing network 100. The audio profile may correspond to each flow device 144 based on the position of the flow device within the cabinet 108. For instance, a first audio profile may correspond to a first flow device forming an upper spray arm and a second audio profile may correspond to a second flow device forming a lower spray arm. Fluid ejected from the respective flow devices may generally have separate audio profiles corresponding to desired operation.

In some embodiments, method 1000 at 1020 includes comparing an audio parameter from the signal to a threshold parameter corresponding to proper operation of the appliance. For instance, the audio parameter may include an amplitude from the signal, and the threshold parameter may include a threshold amplitude corresponding to proper operation of the appliance. In another instance, the audio parameter may include a frequency from the signal, and the threshold parameter may include a threshold frequency corresponding to proper operation of the appliance. Comparing the signal to the audio profile may include any appropriate method for signal processing. The threshold parameter may include a deviation from a nominal audio parameter, such as a nominal amplitude or frequency, such as a percentage or statistical deviation from the nominal audio parameter. For instance, the deviation may be greater or lesser than 2% from the audio profile, or greater or lesser than 5% from the audio profile, or greater or lesser than 10% from the audio profile, or greater or lesser than 20% from the audio profile, etc. (e.g., improper operation of the appliance may be greater than 2% deviation from a nominal amplitude or frequency from the audio profile).

During operation of the appliance 102, 104 configured to execute steps of the method 1000, desired operation of the flow device 144 may be determined by obtaining the signal (e.g., audio signal) and comparing the signal to the audio profile (e.g., an audio parameter), such as described regarding steps 1010, 1020. In some embodiments, positioning the sensor 150, such as configured as a microphone, opposite of the flow device 144 (e.g., step 1008) obtains a signal that may further distinguish the audio signals from the flow device(s) from one another (e.g., distinguishing the upper spray arm from the lower spray arm). Processing the sound generated from fluid from the respective flow devices 144 contacting the opposite surface may allow the controller 120 to determine whether the flow device 144 is functioning properly.

In various embodiments, method 1000 may include at 1030 obtaining an operational parameter signal at the pump (e.g., pump 146), and at 1040 comparing the operational parameter signal to an operational parameter threshold to determine whether the pump is operating properly. In some embodiments, the operational parameter signal and the operational parameter threshold corresponds to a current signal, a voltage signal, or other energy usage parameter at the pump. For instance, method 1000 at 1030 may include obtaining a current draw signal corresponding to electrical current draw at the pump, and at 1040 comparing the current draw signal to a current draw threshold to determine whether the pump is operating properly. For instance, the current draw threshold.

As described above, the pump may be operably coupled to a controller (e.g., controller 120) to send the operational parameter signal indicative of operation of the pump. Comparing the operational parameter signal to the operational parameter threshold may be similar to as described in regard to comparing the signal and audio profile as described above.

During operation of the appliance 102, 104 and method 1000, determining malfunction or non-function of the pump may determine whether malfunction or non-function of the flow device is based on the pump or based on the flow control device (e.g., flow control device 148). For instance, determining malfunction or non-function of the flow device (e.g., steps 1010, 1020) and determining proper function of the pump (e.g., steps 1030, 1040) may determine malfunction or non-function of the flow control device.

One or more of the method 1000 may be stored at the controller 120 and executed locally at the appliance 102, 104. In some embodiments, one or more steps of the method 1000 are stored in the computing network 100, such as the cloud network 132, the remote server 112, or the external device 110. For instance, profiles or thresholds described herein may be stored in the computing network 100. Remote server 112 or external device 110 may receive signal(s) from the appliance 102, 104, such as described above, and determine fault or function at the appliance 102, 104 remotely. An output signal may be transmitted to the appliance 102, 104 or external device 110, such as may form a user communication signal indicating an operational state (e.g., on/off, proper functioning, malfunctioning, etc.) of the flow device 144, the flow control device 148, or the pump 146.

Embodiments of the appliance 102, 104, method 1000, and network 100 provided herein may allow for local or remote determination of an operational state, fault, or functionality of one or more components of the appliance 102, 104. Embodiments provided herein may obviate requiring a user or technician to visually inspect or manually determine functionality of one or more components of the appliance. Additionally, or alternatively, embodiments provided herein may provide fault and functionality detection systems and methods without requiring water or fluid protection of sensors exposed to a wash chamber (e.g., cameras or visual devices positioned in contact with water, detergents, dirt, etc. at a wash chamber). Still further, or alternatively, embodiments configuring the sensor as a microphone may provide low-cost solutions such as described herein. Furthermore, or alternatively, the sensor configured as a microphone may obtain sound vibrations associated with fluid contact such as described herein without obtaining vibrations that may be associated with vibration, rotation, or operation of other components at the appliance or outside of the appliance.

It should be appreciated that the present subject matter is not limited to any particular style, model, or configuration of dishwashing or laundry washing appliance. Exemplary embodiments depicted and described herein are provided for illustrative purposes only.

Further aspects of the present disclosure are provided in one or more of the following clauses:

1. An appliance, the appliance including a cabinet including a plurality of panels, the plurality of panels forming an interior volume at which a wash chamber is positioned; a flow device configured to flow a fluid at the wash chamber; and a microphone positioned at the cabinet, the microphone configured to obtain sound vibrations from the wash chamber.
2. The appliance of any one or more clauses herein, wherein the plurality of panels forming the cabinet includes one or more walls opposite of the flow device relative to a direction along which fluid is ejected from the flow device, and wherein the microphone is positioned at the one or more panels opposite of the flow device.
3. The appliance of any one or more clauses herein, wherein the plurality of panels forming the cabinet includes an upper panel, and wherein the microphone is positioned at the upper panel.
4. The appliance of any one or more clauses herein, wherein the flow device is a spray bar, a nozzle, a rotatable blade, or agitator at the wash chamber.
5. The appliance of any one or more clauses herein, wherein the microphone is a piezoelectric microphone.
6. The appliance of any one or more clauses herein, wherein the appliance is a dishwashing appliance or a laundry washing appliance.
7. The appliance of any one or more clauses herein, the appliance including a pump configured to move the fluid to or from the wash chamber; and a controller configured to execute operations, the operations including obtaining a signal from the microphone during flow of the fluid at the wash chamber; and comparing the signal to a predetermined audio profile corresponding to operation of the flow device at the wash chamber to determine whether the flow device is operating properly.
8. The appliance of any one or more clauses herein, wherein comparing the signal includes comparing an amplitude from the signal to a threshold amplitude corresponding to proper operation of the appliance.
9. The appliance of any one or more clauses herein, the operations including obtaining a current draw signal corresponding to electrical current draw at the pump; and comparing the current draw signal to a current draw threshold to determine whether the pump is operating properly.
10. A method for determining an operational state of a component at an appliance, the method including obtaining, from a sensor positioned at a cabinet at which a wash chamber is positioned, a signal during flow of a fluid at the wash chamber; and comparing the signal to a predetermined operational profile corresponding to operation of the flow device at the wash chamber to determine whether the flow device is operating properly.
11. The method of any one or more clauses herein, wherein comparing the signal includes comparing an amplitude from the signal to a threshold amplitude corresponding to proper operation of a flow device configured to flow the fluid at the wash chamber.
12. The method of any one or more clauses herein, the operations including obtaining an operational parameter signal corresponding to electrical draw at a pump configured to move fluid to or from the wash chamber; and comparing the operational parameter signal to an operational parameter threshold to determine whether the pump is operating properly.
13. The method of any one or more clauses herein, the method including positioning the sensor at a panel opposite of a flow device configured to eject fluid into the wash chamber, the panel forming at least a portion of the cabinet.
14. The method of any one or more clauses herein, wherein the sensor is positioned at an upper panel of the cabinet.
15. A washing appliance, the washing appliance including a cabinet including a plurality of panels, the plurality of panels forming an interior volume at which a wash chamber is positioned; a flow device configured to flow a fluid at the wash chamber; a diverter configured to switch a direction of the flow of fluid; a microphone positioned at the cabinet, the microphone configured to obtain sound vibrations from the wash chamber; a pump configured to move the fluid to or from the wash chamber; and a controller configured to execute operations, the operations including obtaining a signal from the microphone during flow of the fluid at the wash chamber; and comparing the signal to a predetermined audio profile corresponding to operation of the flow device at the wash chamber to determine whether the flow device is operating properly.
16. The washing appliance of any one or more clauses herein, wherein comparing the signal includes comparing an amplitude from the signal to a threshold amplitude corresponding to proper operation of the appliance.
17. The washing appliance of any one or more clauses herein, the operations including:

obtaining a current draw signal corresponding to electrical current draw at the pump; and comparing the current draw signal to a current draw threshold to determine whether the pump is operating properly.

18. The washing appliance of any one or more clauses herein, wherein the plurality of panels forming the cabinet includes one or more walls opposite of the flow device relative to a direction along which fluid is ejected from the flow device, and wherein the microphone is positioned at the one or more panels opposite of the flow device.
19. The washing appliance of any one or more clauses herein, wherein the flow device is a spray bar, a nozzle, a rotatable blade, or agitator at the wash chamber.
20. The washing appliance of any one or more clauses herein, wherein the microphone is a piezoelectric microphone.
21. A washing appliance configured to execute the method of any one or more clauses herein.
22. An appliance configured to execute the method of any one or more clauses herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, the appliance comprising:

a cabinet comprising a plurality of panels, the plurality of panels forming an interior volume at which a wash chamber is positioned;

a flow device configured to flow a fluid at the wash chamber;

a flow control device configured to selectively permit, inhibit, throttle, direct, or divert flow of the fluid to the flow device;

a pump configured to move the fluid to or from the wash chamber;

a microphone positioned at the cabinet, the microphone configured to obtain sound vibrations from the wash chamber; and a controller configured to execute operations, the operations comprising:

obtaining a signal from the microphone during flow of the fluid at the wash chamber;

comparing the signal to a predetermined audio profile corresponding to operation of the flow device at the wash chamber to determine whether the flow device is operating properly;

obtaining a current draw signal corresponding to electrical current draw at the pump;

comparing the current draw signal to a current draw threshold to determine whether the pump is operating properly; and determining malfunction or non-function of the flow control device based on determining malfunction or non-function of the pump and based on determining malfunction or non-function of the flow device, wherein determining malfunction or non-function of the pump is based on comparing the current draw signal to the current draw threshold, and wherein determining malfunction or non-function of the flow device is based on comparing the signal to the predetermined audio profile.

2. The appliance of claim 1, wherein the plurality of panels forming the cabinet comprises one or more walls opposite of the flow device relative to a direction along which fluid is ejected from the flow device, and wherein the microphone is positioned at the one or more panels opposite of the flow device.

3. The appliance of claim 1, wherein the plurality of panels forming the cabinet comprises an upper panel, and wherein the microphone is positioned at the upper panel.

4. The appliance of claim 1, wherein the flow device is a spray bar, a nozzle, a rotatable blade, or agitator at the wash chamber.

5. The appliance of claim 1, wherein the microphone is a piezoelectric microphone.

6. The appliance of claim 1, wherein the appliance is a dishwashing appliance or a laundry washing appliance.

7. The appliance of claim 1, wherein comparing the signal comprises comparing an amplitude from the signal to a threshold amplitude corresponding to proper operation of the appliance.

8. A method for determining an operational state of a component at an appliance, the method comprising:

obtaining, from a sensor positioned at a cabinet at which a wash chamber is positioned, a signal during flow of a fluid at the wash chamber; and comparing the signal to a predetermined operational profile corresponding to operation of a flow device at the wash chamber to determine whether the flow device is operating properly;

obtaining an operational parameter signal corresponding to electrical current draw at a pump configured to move fluid to or from the wash chamber, wherein the operational parameter signal comprises a current signal or a voltage signal;

comparing the operational parameter signal to an operational parameter threshold to determine whether the pump is operating properly; and determining malfunction or non-function of the flow control device based on determining malfunction or non-function of the pump and based on determining malfunction or non-function of the flow device, wherein determining malfunction or non-function of the pump is based on comparing the operational parameter signal to the operational parameter threshold, and wherein determining malfunction or non-function of the flow device is based on comparing the signal to the predetermined audio profile.

9. The method of claim 8, wherein comparing the signal comprises comparing an amplitude from the signal to a threshold amplitude corresponding to proper operation of a flow device configured to flow the fluid at the wash chamber.

10. The method of claim 8, the method comprising:

positioning the sensor at a panel opposite of the flow device configured to eject fluid into the wash chamber, the panel forming at least a portion of the cabinet.

11. The method of claim 10, wherein the sensor is positioned at an upper panel of the cabinet.

12. A washing appliance, the washing appliance comprising:

a cabinet comprising a plurality of panels, the plurality of panels forming an interior volume at which a wash chamber is positioned;

a plurality of flow devices configured to flow a fluid at the wash chamber;

a diverter configured to switch a direction of the flow of fluid among the plurality of flow devices;

a microphone positioned at the cabinet, the microphone configured to obtain sound vibrations from the wash chamber;

a pump configured to move the fluid to or from the wash chamber; and a controller configured to execute operations, the operations comprising:

obtaining a signal from the microphone during flow of the fluid at the wash chamber;

comparing the signal to a predetermined audio profile corresponding to operation of the flow device at the wash chamber to determine whether the flow device is operating properly;

obtaining a current draw signal corresponding to electrical current draw at the pump;

comparing the current draw signal to a current draw threshold to determine whether the pump is operating properly; and determining malfunction or non-function of the diverter based on determining malfunction or non-function of the pump and based on determining malfunction or non-function of the flow device, wherein determining malfunction or non-function of the pump is based on comparing the current draw signal to the current draw threshold, and wherein determining malfunction or non-function of the flow device is based on comparing the signal to the predetermined audio profile.

13. The washing appliance of claim 12, wherein comparing the signal comprises comparing an amplitude from the signal to a threshold amplitude corresponding to proper operation of the appliance.

14. The washing appliance of claim 12, wherein the plurality of panels forming the cabinet comprises one or more walls opposite of the flow device relative to a direction along which fluid is ejected from the flow device, and wherein the microphone is positioned at the one or more panels opposite of the flow device.

15. The washing appliance of claim 12, wherein the flow device is a spray bar, a nozzle, a rotatable blade, or agitator at the wash chamber.

16. The washing appliance of claim 12, wherein the microphone is a piezoelectric microphone.

* * * * *